US005899789A

United States Patent [19]

Rehkemper et al.

[11] Patent Number: 5,899,789

[45] Date of Patent: May 4, 1999

[54] TOY CAR TRACK ASSEMBLY WITH PROPELLING MECHANISM AND COLLISION COURSE

[76] Inventors: Jeffrey G. Rehkemper, 1636 N. Wells, Chicago, Ill. 60614; Steven Rehkemper, 1030 N. State St., Chicago, Ill. 60610

[21] Appl. No.: 08/975,578

[22] Filed: Nov. 21, 1997

[51] Int. Cl.[6] ..... A63H 18/14

[52] U.S. Cl. ..... 446/444; 446/431

[58] Field of Search ..... 446/431, 444, 446/446, 429, 457, 462, 465; 238/10 F, 10 E; 104/63; 472/3, 27, 48

[56] References Cited

U.S. PATENT DOCUMENTS

| | | | |
|---|---|---|---|
| 4,091,561 | 5/1978 | Kimura | 446/137 |
| 4,128,964 | 12/1978 | Ogasawara | 446/171 |
| 4,394,961 | 7/1983 | Muller | 238/10 R |
| 4,516,953 | 5/1985 | Hippely et al. | 446/444 |
| 4,519,789 | 5/1985 | Halford et al. | 446/444 |
| 4,605,230 | 8/1986 | Halford et al. | 273/129 AP |
| 5,102,133 | 4/1992 | Chilton et al. | 238/10 F |
| 5,234,216 | 8/1993 | Ostendorff | 273/127 |
| 5,299,969 | 4/1994 | Zaruba | 446/429 |
| 5,452,893 | 9/1995 | Faulk et al. | 273/86 |
| 5,735,724 | 4/1998 | Udagawa | 446/172 |
| 5,785,573 | 7/1998 | Rothbarth et al. | 446/171 |

*Primary Examiner*—Robert A. Hafer
*Assistant Examiner*—Michael B. Priddy
*Attorney, Agent, or Firm*—Jack Shore; Hamman & Benn

[57] ABSTRACT

A track system including a continuous track comprising a spiral track section interconnecting upper and lower track sections. The spiral track section exits into a powered roller assembly that receives a toy car from the spiral track and impels it along the track. The car leaving the rollers moves over an opening in a horizontal section and then through an inverted vertically disposed loop leading back to the opening to a lower track section and back to the spiral track section. The construction of the track creates a mid-air collision course that will occur if the car is moving over the opening when a car is exiting from the vertically disposed loop.

20 Claims, 2 Drawing Sheets

10
12
16
18
20
22
24
26
28
30
32
34
36
44
50
52
54
56
58
60
62
64
66
2
3

TOY CAR TRACK ASSEMBLY WITH PROPELLING MECHANISM AND COLLISION COURSE

FIELD OF THE INVENTION

This invention relates to a toy car track assembly in which a toy automobile is directed by a propelling mechanism through a track arrangement that includes a car collision track intersection.

BACKGROUND OF THE INVENTION

There are, of course, a variety of car track assemblies for use by toy cars that normally includes a continuous track for impelled or self-powered cars. The track assembly may include a separate impelling mechanism that engages the toy car to move it with sufficient force so it will circumnavigate the track and return to the impelling mechanism so it will move around the continuous track until the power for the impelling mechanism is turned off. Generally speaking, these road tracks can consist of single or multiple runs along which cars can compete in some racing function or the continuous track system can take other configurations, including tunnels, bridges, etc.

As aforementioned, toy cars used in one of these track configurations may either be moved by power-driven rollers engaging the cars or the cars may contain a small battery operated electric motor disposed therewithin whereby the car will move under its own power. The foregoing arrangements provide enjoyment to those playing with the same but such arrangement are limited to cars merely racing around the track in competition with each other or on some are limited to cars merely racing around the track in competition with each other or on some timing basis. In order to increase the enjoyment available from a car and track assembly, it is desirable to provide a track system that will provide more than merely a static racing track and will include other features that will further add to the pleasure of those playing with the car and track assembly.

SUMMARY OF THE INVENTION

In accordance with the present invention, there is provided a unique track system assembly in which the cars are positively moved up a spiral track and ejected into engagement with a pair of rollers that impels the cars onto a track configuration that could result in a smooth movement of the car around the track. In accordance with the instant invention the track is so configured that a portion of the track intersects with another section that could result in a collision with one or more of the cars being knocked off of the track.

The invention encompasses a number of different configurations wherein the track is designed to bring about a mid-air collision. Examples of such designs would include an upwardly extending track intersecting with a vertically disposed section; two downwardly extending intersecting sections, an arrangement in which the longitudinal movement of the car in an elevated position crosses the path of a car exiting from an inverted loop regardless of the particular orientation of the longitudinal path i.e. horizontal, vertical or something in between and other configurations of vertically and horizontally disposed sections that intersect at an elevated level that could result in a mid-air collision. The illustrated embodiment, which is by way of example includes a vertically disposed circular loop that crosses an includes a vertically disposed circular loop that crosses an elevated horizontal section of the track, with the result that it is possible that succeeding cars moving along the track could result in a collision of two cars at the juncture where the vertical loop section intersects the horizontal portion of the track on which a car is moving.

This invention further includes a tower assembly including a spiral track arrangement disposed about a centrally disposed, positively driven cushioned drum mechanism. The width of the spiral track and car is such that the cushioned drum will always be in contact with the car, with the result that when the car enters the spiral track, the rotating drum will move the car up the track from its lower inlet to its upper elevated outlet where the car is ejected onto a horizontal track section. As the car is propelled from the exit of the spiral track, the car comes into contact with a pair of motor-driven rollers whereby the car is projected forward at a still higher rate of speed that is sufficient to move the car throughout the track system and returns it to the inlet of the spiral infeed track where the cycle begins again. The track is designed so that the section of the track connected to the horizontal section adjacent the power-driven rollers consists of an upwardly extending inverted loop that the car passes around on its way to the balance of the track assembly. As illustrated, the balance of the track is generally horizontally disposed and includes suitable curved and banked sections as well as straight-a-ways.

In order to provide a track intersection whereby a mid-air collision course is provided a section of the track assembly after the car is impelled from the rollers includes an opening over which the car will pass. This section leads to an inverted loop section and down onto a curved section leading to a generally horizontal track arrangement that leads back to the inlet of the upwardly disposed spiral track. Thus, when a single car is placed at the entrance to the spiral track it will move along up the spiral track into the space between the power driven rollers along an upwardly disposed horizontal section and, over the opening on the raised horizontal section. The car then moves along the inverted loop down through the same opening and onto the curved and horizontal sections of the track and ultimately back to the inlet of the spiral track. The opening that is located in the raised horizontal track section adjacent the end of the inverted loop has a width to allow a car to pass through when vertically disposed, and a length of an appropriate dimension so long as the speed of the car as determined by the power driven rollers is sufficient to move the car over the opening after being impelled forward by the rollers and enter the loop. If the car moving across the opening comes into contact with a car exiting the loop, a mid-air collision will occur and one or both cars will be knocked off of the track. It can be appreciated that there is skill involved in operating cars so that the collision will occur and similarly skill is required to avoid the collision from occurring. This substantially adds to the enjoyment of one playing with cars on the track assembly. Additionally two or more people may be placing cars on the track, and it can become a competitive situation to see how long they can keep their car running without colliding.

BRIEF DESCRIPTION OF THE DRAWINGS

Other advantages can be seen from the following drawings, wherein.

BRIEF DESCRIPTION OF THE ILLUSTRATED EMBODIMENT

Figures 1, 2:
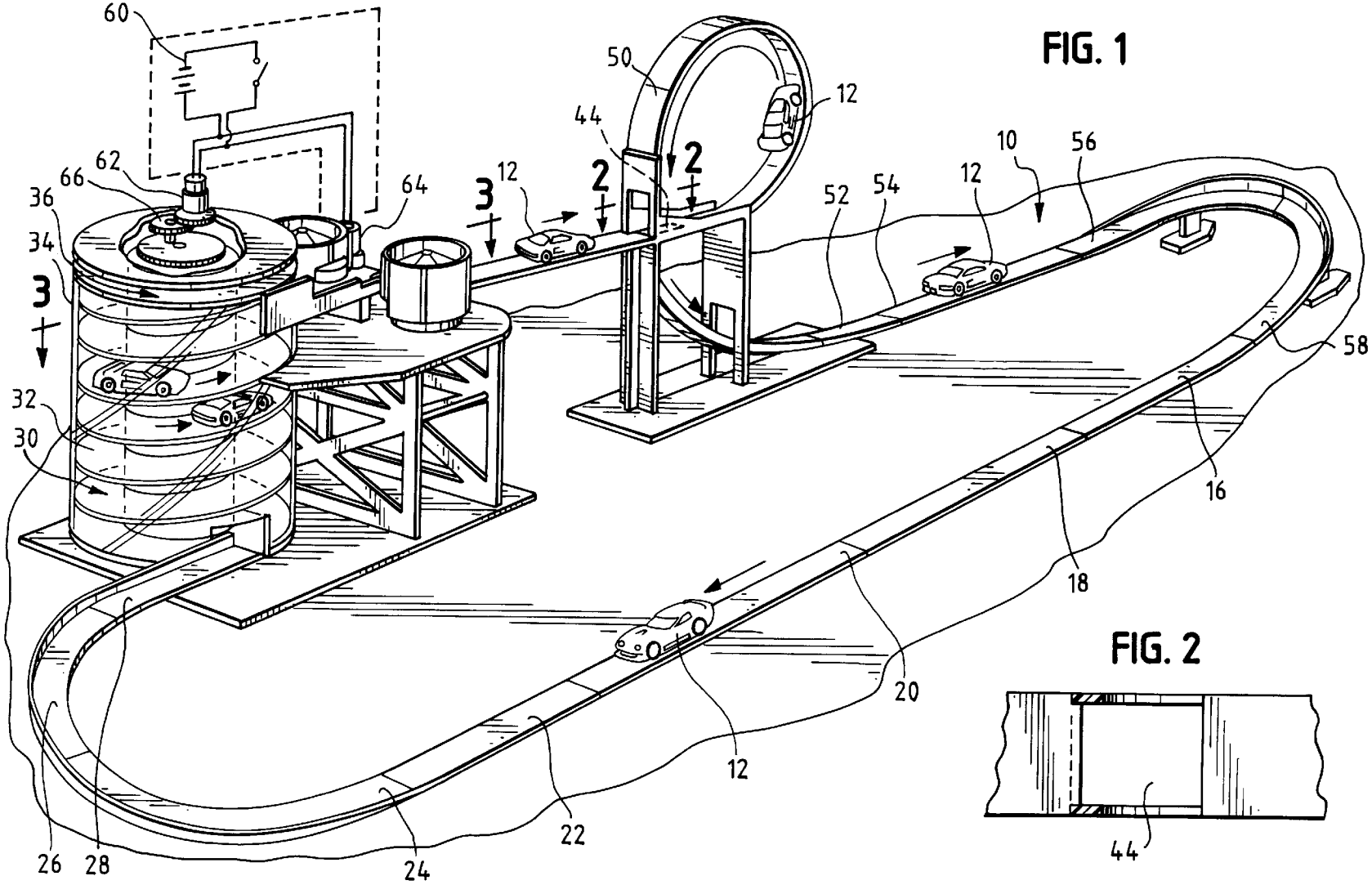
FIG. 1 is a perspective view of a complete novel track assembly showing the spiral infeed drive mechanism, the power roller propelling mechanism, and the unique track construction providing a mid-air crash feature.
FIG. 2 is a section taken along line 2—2 of FIG. 1 showing the exit opening for the car completing the loop.
Figure 3:
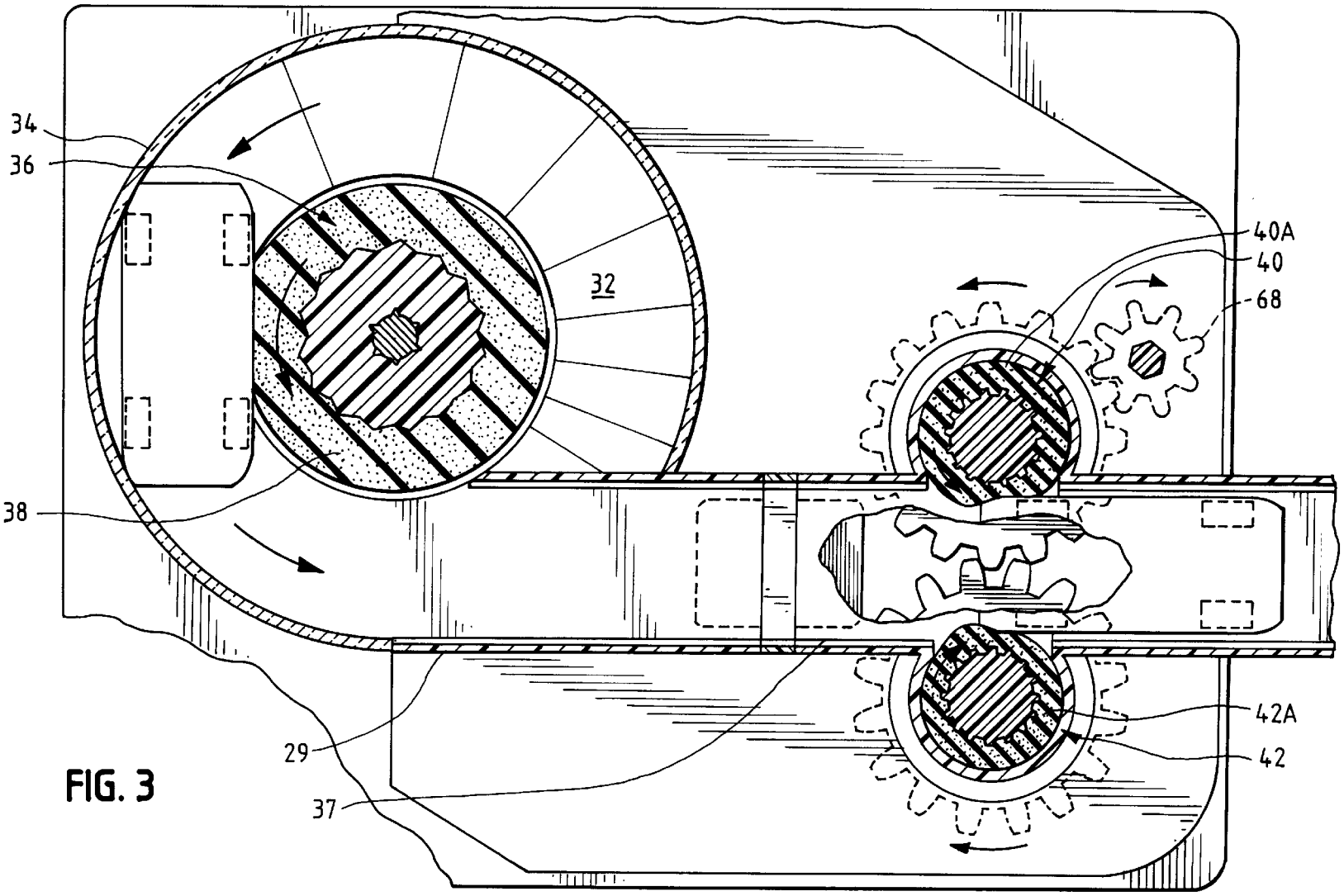
FIG. 3 is a partially sectioned plan view taken along line 3—3 of FIG. 1 showing a car exiting from the spiral track of the drive tower to the inlet of the upper horizontal track section and the drive roller mechanism for propelling the car along the track.

Referring first to FIG. 1, there is illustrated a continuous complete track assembly along which cars 12 move. The track assembly 10 is but one configuration that can be employed and in the illustrated embodiment includes on one side essentially flat sections 16, 18, 20, 22 that leads to interconnected curved and banked sections 24, 26. Section 26 connects to the inlet section 28 of the power-driven tower 30 that functions to engage the car 12 to move it up to the tower outlet section 29 (FIG. 3). Specifically, the tower 30 includes a spiral track 32 that is defined by an outer cylindrical wall 34 and a power driven cylindrical roller assembly 36. The track section 32 on which the cars 12 ride extends from the tower inlet section 28 upward to the tower exit horizontal track section 29 (FIG. 3). The spiral track 32 is stationary and has a dimension slightly less than the width of the cars 12 whereby the cars on the spiral track will be engaged by the outer cushioned surface 38 of the roller assembly 36. The cars are moved up the spiral track 32 by the centrally disposed cylindrical roller assembly 36 located within the tower 30. The movement of the cars 12 up the spiral track 32 depends on the speed of the roller assembly 36. As the car leaves the upper end of the spiral track 32 the car is propelled onto the horizontal track section 37 into a slightly constricted section between two power-driven rollers 40,42. The rollers 40, 42 have cushioned outer surfaces 40*a*, 42*a* that engage the side of the cars 12 and propel them at an increased speed along upper horizontal track section 37 over track opening 44 to the inner surface of the vertically extending track loop 50. The track opening 44 in the illustrated embodiment is formed in the vertically disposed frame support 51 which serves to support upper track section 37, vertically disposed loop 50 and downwardly extending curved portion 52. The speed of the cars leaving the power-driven rollers 40, 42 moves cars easily through the loop 50 and down through the opening 44 onto the lower downwardly extending curved portion 52 of the track and onto the horizontal track section 54. From the horizontal section 54, the track continues to curved banked sections 56, 58 back to horizontal section 16. The opening 44 shown is of a length that the car 12 will pass over after being compelled by the rollers a is wider than the width of the car whereby the car 12 will not fall through the opening when it passes thereover but when it exits the curved loop 50 it will move therethough onto curved track section 52.

The drive mechanism for the cylindrical tower roller 36 and the drive rollers 40, 42 are schematically illustrated in FIG. 1. The electric power source is supplied by a suitable power source such as batteries 60 that operate motors 62, 64 which through suitable gear mechanisms 66, 68 respectively drive the cylindrical tower 36 and rollers 40, 42, respectively.

For more specific information regarding the tower construction and the rollers 40, 42 reference is made to FIG. 3. It is seen that the car 12 exiting the upper portion of the spiral track 32 moves over track section 29 into the space between the rollers 40, 42, which has an outwardly cushioned surface to facilitate contact with the car during its movement therebetween. The rollers 40, 42 impel the car 12 at a relatively high speed along upper track section 37. The forward speed of the car on track section 37 moves it over the opening 44. The car 12 moves around on the inner surface of the loop 50, and when it exits the vertical portion of the loop 50 it will normally pass through the opening 44 onto lower curved track section 52 from where it moves around the track to the inlet section 28 of the tower 30. If a series of cars is placed on the track, it can be appreciated that if a car is projected from the rollers 40, 42 and reaches the opening 48 at the same time that a preceding car 12 is moving down the vertical section of the loop 50 across the path of the car on section 37, a collision will occur and one or both of the cars will be knocked off of the track. This built-in feature further enhances the pleasure one will obtain from playing with this unique track construction.

While one embodiment has been illustrated and described, it is, of course, intended to cover by the appended claims all such modifications as fall within the true spirit and scope of the invention. For example, while the collision course illustrated includes a vertical loop arrangement, the invention is not restricted to this specific arrangement and encompasses any of a variety of elevated track arrangements that include intersections that when two cars reach the intersection at the same time a mid-air collision will occur. One such arrangement among others consists of a longitudinally extending track that is disposed horizontally, vertically or angled from the horizontal that intersects the exit portion of a vertical loop.

What is claimed is:

1. A track system for toy cars comprising a continuous track assembly including a spiral drive track section and an upwardly extending loop section forming a part of and intersecting a longitudinally extending section of the track assembly, said longitudinally extending section defining an opening at the juncture of the longitudinally extending and loop sections whereby said loop section, also defining an opening at said juncture, passes through said horizontally extending section, a driving mechanism for moving a car on said spiral track upward to the top of said spiral track and outwardly therefrom, power-driven rollers disposed on said track assembly adjacent the top of said spiral track for engaging and impelling the car around the track system over said opening and through said loop section, means for supporting said longitudinally extending and loop sections in a elevated position whereby if the cars come into contact adjacent the opening in the track a mid-air collision will occur and one or more cars may fall of the track.

2. A track system as set forth in claim 1 in which the longitudinally extending section is horizontally disposed and the loop section is vertically disposed relative to said horizontal section.

3. A track system as set forth in claim 2 in which the opening in the longitudinal section is of a length so that the power driven rollers will propel the car thereover but slightly wider than the car to permit the car to pass through the opening when exiting the loop.

4. A track system as set forth in claim 1 in which the spiral track is slightly less than the width of the car and is disposed around a power-driven cylinder that engages the cars on the spiral track to move them up the spiral track.

5. A track system as set forth in claim 4 including a source of electric power, and separate motors and gear systems for driving said rollers and cylinder from said source of power.

6. A track system as set forth in claim 4 in which the power driven cylinder includes an outer cushioned cylindrical surface that frictionally engages said cars to move them up said spiral track.

7. A track system as set forth in claim 1 in which the power driven rollers each have a cushioned surface and are spaced apart a distance slightly less then the width of the model car to engage the car and impel it along the track system.

8. A track assembly for model cars comprising a plurality of track sections, including a first elevated section extending in a first plane and a second elevated section in a second plane intersecting said first plane, means supporting said elevated sections relative to each other and in intersecting relationship, said first and second elevated sections defining a common open area at the juncture of the intersecting sections whereby a car can move from said second elevated section through said first elevated section or vice versa to the balance of the track assembly and if cars from both sections enter the common area at the same time a mid air collision will occur to knock the cars off of the track assembly.

9. A track assembly as set forth in claim 8 in which the first plane extends in a generally horizontal direction and the second plane extends generally normal to said first plane.

10. A track assembly as set forth in claim 9 in which the open area in the horizontally extending track section is of a length that the car riding on the track will pass thereon but is wider than the width of a car to permit the car to pass therethrough.

11. A track assembly as set forth in claim 8 in which the first elevated track section extends in a longitudinal direction and the second elevated track section includes an upwardly extending loop.

12. A continuous track assembly including a track system for a toy vehicle including interconnected lower and upper vertically disposed sections, means for supporting said upper section, a track portion of said upper section consisting of an (interconnected) intersecting longitudinally extending section and an upwardly extending loop section, the longitudinally extending section (defining an opening at the base of said loop section) and upwardly extending loop section defining a common open area through which the vehicle may pass continuously around the track but may be moved off the track by a mid-air collision involving contacting vehicles where the loop intersects with the longitudinally extending section. (at the opening in the longitudinally extending section.).

13. A continuous track assembly as set forth in claim 12 in which the longitudinally extending track section is horizontally disposed and the loop section is disposed normal to said horizontal section.

14. A spiral track assembly for connecting vertically spaced upper and lower track sections, said spiral track assembly including a spiral track defined between an outer wall and (located around) a cylindrical roller said cylindrical roller including an outer cushioned surface positioned to engage a model car, the distance between said outer wall and said outer cushioned surface being (that) slightly narrower than the width of the model car and the cylindrical roller includes an outer cushioned surface position to engage said car, means for driving said cylindrical roller whereby when a model car is placed on said track it will be gripped between said outer wall and said outer cushioned surfaces and thus be moved between said (upper and) lower and upper track sections.

15. A spiral track assembly in accordance with claim 14 in which the means for driving said roller consists of a battery operated motor which is connected through suitable gearing to said roller.

16. A spiral track assembly in accordance with claim 14 in which the roller assembly is enclosed in a cylindrical housing and the spiral track is formed between said housing and roller assembly.

17. A continuous track system for model cars including a vertically extending track loop section having an exit end and an intersecting generally straight track path section (transversing) traversing the exit end of said loop, which sections define an open intersecting area, and means for supporting said loop and portions of the straight track path in an elevated position whereby when cars in said track path and one exiting said loop enter (intersection) said intersecting area simultaneously a mid-air collision will occur.

18. A continuous track system as set forth in claim 17 including a generally horizontal track arrangement and an angularly extending downwardly disposed track section adjacent intersection for receiving cars exiting from said loop section.

19. A continuous track system as set forth in claim 17 in which the angularly disposed section is secured to said support means.

20. A continuous track system as set forth in claim 17 including a powered roller system for engaging and propelling the model cars around and through said loop section.

* * * * *